US005457974A

United States Patent [19]

Keller

[11] Patent Number: 5,457,974

[45] Date of Patent: Oct. 17, 1995

[54] KEY AND ROTARY LOCKING CYLINDER FOR A SAFETY LOCK

[76] Inventor: Ernst Keller, Untere Schwandenstrasse 22, CH-8805 Richterswil, Switzerland

[21] Appl. No.: 204,854

[22] Filed: Mar. 2, 1994

[30] Foreign Application Priority Data

Mar. 30, 1993 [CH] Switzerland ..... 975/93

[51] Int. Cl.[6] ..... E05B 27/06

[52] U.S. Cl. ..... 70/358; 70/359; 70/409; 70/421; 70/492

[58] Field of Search ..... 70/358, 359, 356, 70/395, 398, 405–407, 409, 421, 492

[56] References Cited

U.S. PATENT DOCUMENTS

| | | | |
|---|---|---|---|
| 4,434,636 | 3/1984 | Prunbauer | 70/358 |
| 4,612,787 | 9/1986 | Prunbauer et al. | 70/358 |
| 4,667,495 | 5/1987 | Girard et al. | 70/398 |
| 5,123,268 | 6/1992 | Eizen | 70/359 |

FOREIGN PATENT DOCUMENTS

| | | | |
|---|---|---|---|
| 0202949 | 11/1986 | European Pat. Off. . | |
| 388516 | 9/1990 | European Pat. Off. | 70/358 |
| 472495 | 2/1992 | European Pat. Off. | 70/358 |
| 1036572 | 4/1953 | France . | |
| 2521201 | 8/1983 | France | 70/398 |
| 2561293 | 9/1985 | France | 70/358 |
| 2619149 | 2/1989 | France | 70/398 |
| 3517660 | 11/1985 | Germany . | |
| 2161204 | 1/1986 | United Kingdom | 70/358 |

*Primary Examiner*—Peter M. Cuomo
*Assistant Examiner*—Suzanne L. Dino
*Attorney, Agent, or Firm*—McAulay Fisher Nissen Goldberg & Kiel

[57] ABSTRACT

A key and rotary cylinder for a safety lock are disclosed. The key has in its shank a continuous bore hole in which two opposite control elements are supported. These control elements are movable inwardly against the restoring force of a pressure spring arranged in the bore hole. An additional tumbler is lifted by a control element when the key is inserted into a key slot of the rotary locking cylinder. This additional tumbler engages in a recess of the stator. When using a key without a control element, the rotor is blocked by means of the tumbler. When using a key according to the invention, the rotor can be turned and the tumbler is lifted out of the recess and the control element is moved inward radially. After turning by 90°, for example, a counterpin of the stator is brought into line by the tumbler. In the absence of a control element, the rotor is blocked by the counterpin in this case as well.

6 Claims, 3 Drawing Sheets

KEY AND ROTARY LOCKING CYLINDER FOR A SAFETY LOCK

BACKGROUND OF THE INVENTION

1. Field of the Invention

The invention is directed to a key and a rotary locking cylinder as well as to a key for a rotary locking cylinder with an additional tumbler.

2. Background Art

The advantage of keys of this generic type is that the control element arranged in the shank virtually prevents unauthorized copying so that locking arrangements outfitted with such keys are more secure. However, known keys of this type, also called "mechanical keys", are still subject to various disadvantages and so have not achieved widespread use, particularly as turning keys, in spite of their very high security against copying.

A key of this generic type is known, for example, from DE-A-35 17 660. This key can be inserted into the key slot of a rotary locking cylinder and has, in its planar shank, a movable device by means of which an additional tumbler can be moved into the releasing position. The movable device of the key is formed by a projecting pin which can be held displaceably in a pocket hole of the key. Also arranged in the pocket hole is a spring which presses the pin outward. The pin is prevented from falling out by steps in the pocket hole of the shank and at the pin. Projecting pins are generally disadvantageous in a key, as the key easily becomes caught on the pin.

Another key of this type having a pin which can be displaced in a defined manner for the purpose of bringing into line the additional tumbler in the shank is known from U.S. Pat. No. 4,667,495. When the shank is inserted into the key slot, the pin runs up onto an inclined plane or ramp arranged in the rotor. The ramp displaces the pin radially and the pin accordingly brings the additional tumbler into line. Grooves or other recesses are required at the shank to allow the ramp to reach the pin when the shank is inserted. In the case of a flat key, these grooves limit the surface available for control bore holes. Therefore, in practice, the pin must be arranged as close as possible to the front end of the shank. One end of the easily displaceable pin usually projects out at the shank so that the key can also become caught on this.

A key of this type is also known from EP-A-202 949. The additional tumbler is likewise brought into line in this instance by a pin which is displaceable in a defined manner in the key shank, resulting in the difficulties mentioned above.

OBJECT AND SUMMARY OF THE INVENTION

The primary object of the present invention is to provide a key and rotary locking cylinder of the generic type mentioned above which does not require a recess on the outside of the shank for a ramp arranged in the rotary locking cylinder and which is nevertheless simple to manufacture and extremely secure against copying. This object is met in accordance with the invention by a key and rotary locking cylinder for a safety lock with at least one control element which is arranged in the shank of the key and cooperates with an additional tumbler of the rotor. The control element is displaceable radially against the restoring or reaction force of a pressure spring, for example. The stator has a recess at its inner side in which the tumbler of the rotor 3 engages by means of the action of the control element. The tumbler is movable radially inward against the reaction force when the rotor is rotated. A counterpin which can be brought into line by the tumbler is arranged at a distance from the recess.

In the key according to the invention, the control element can be exactly flush at the outside with a narrow side of the key so that such a key can be distinguished from one without such a control element only by careful scrutiny. If a copied key lacks the control element, the tumbler of the rotor will move out radially into the blocking position when the key shank is inserted into the key slot. This prevents the rotor from turning so that the lock cannot be opened. If there is a bore hole at the outside of the key rather than the control element, the tumbler of the rotor blocks the locking cylinder when this tumbler reaches a counterpin in the stator after the rotor is turned to a certain extent. Due to the absence of the control element, this counterpin is not brought into line and blocks the rotary locking cylinder by engaging in the recess of the rotor.

The rotary locking cylinder is comparatively simple and can accordingly be manufactured at low cost. The additional measures adopted with respect to the stator are comparatively simple, since a conical depression need only be incorporated on the inside of the stator. The tumbler of the rotor can be a simple bolt which is guided into a pocket hole of the rotor so as to be displaceable radially without spring loading.

According to a further development of the invention, the stator has an insert which has the abovementioned recess for the tumbler cooperating with the control element. The insert can be manufactured in a comparatively simple manner from hardened steel or hard metal so that protection against forceful opening of the rotary locking cylinder is considerably improved.

For a better understanding of the present invention, reference is made to the following description and accompanying drawings while the scope of the invention will be pointed out in the appended claims.

DESCRIPTION OF THE PREFERRED EMBODIMENTS

Figure 1:
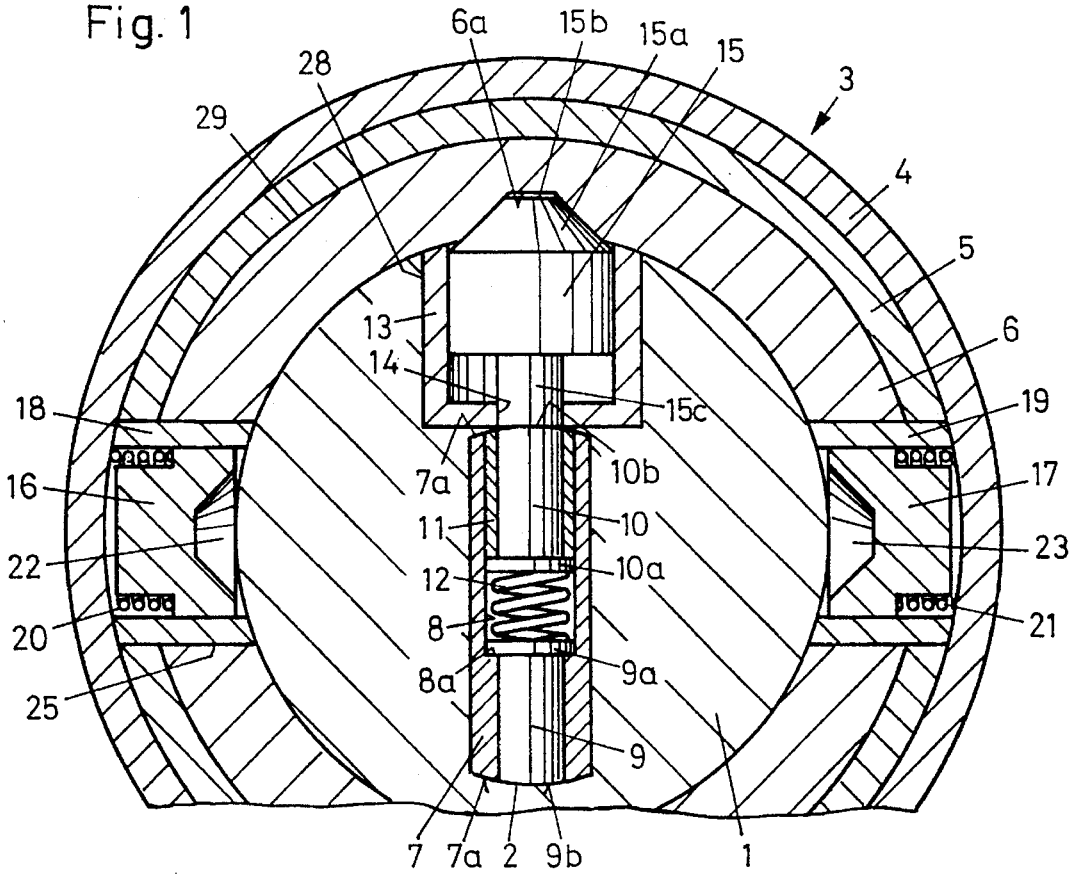
FIG. 1 shows a cross section through a rotary locking cylinder, according to the invention, with inserted key.

FIG. 1 shows a stator 3 with a conventional steel sleeve 4 and a housing 5 in which a rotor 1 is supported so as to be rotatable. Conventional pin tumblers (not shown in the drawing) are brought into line by a key 7 inserted into a key slot 2 of the rotor 1 and the rotor 1 can be turned to actuate a lock (not shown in the drawing). The key 7 has pocket holes appropriate for bringing these conventional tumblers into line. However, the key 7 can also be a so-called serrated key, in which case, of course, the rotary locking cylinder is adapted accordingly.

Figure 5A:
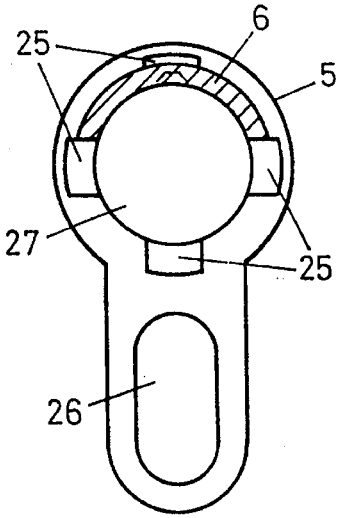
FIGS. 5*a* and 5*b* show a projected view and section, respectively, through a stator housing.
Figure 5B:
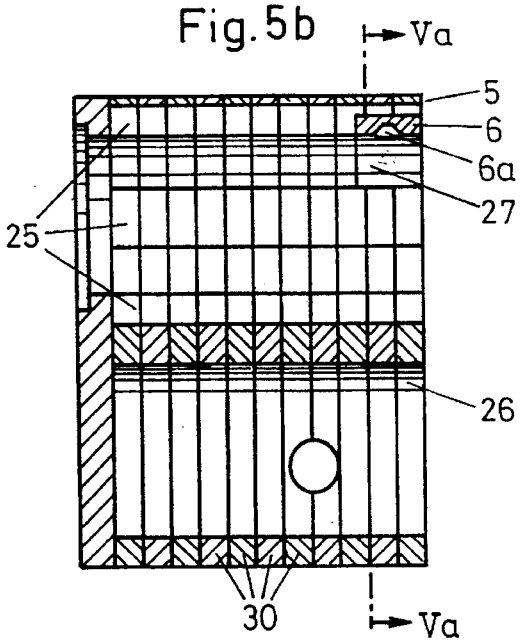
Figure 6A:
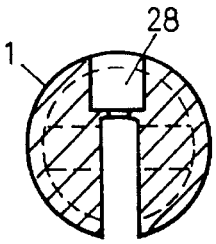
FIGS. 6*a* and 6*b* show views of a rotor.
Figure 6B:
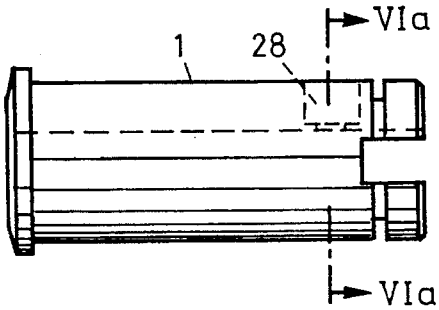
Figure 7A:
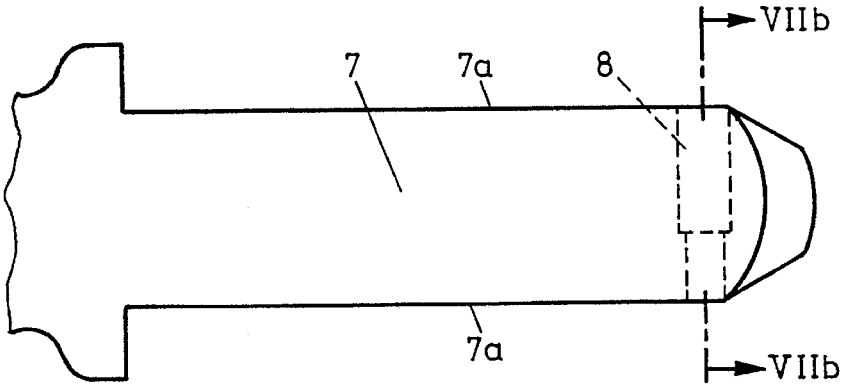
FIGS. 7*a* and 7*b* show a partial view and section, respectively, through a key according to the invention.
Figure 7B:
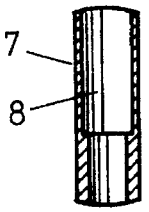

As will be seen from FIGS. 5*a* and 5*b*, the housing 5 of the stator 3 can be produced from bars or plates 30 which are soldered together. The plates 30 are preferably made of hardened steel. A semicircular recess 29 is provided at the rear end of the housing 5 in the upper region, a curved insert 6 which is preferably made of hardened steel or hard metal being inserted in the latter. The insert 6 has a conical pocket hole 6a which cooperates with a tumbler 15 of the rotor 1. In addition, the housing 5 has longitudinal slots 25 in which are inserted slides or bolts 19, known per se. The housing pins 16 are guided in these bolts 19 into bore holes 31 by their springs 20. Such bolts 19 are known per se.

The rotor 1 is provided with a radial bore hole 28 in which is inserted a bushing 13 with a through-opening 14. A tumbler 15 in the form of a cylindrical bolt or pin is guided in the bushing 13 so as to be displaceable radially. The bushing 13 is preferably made of hardened steel. The radial outer end of the tumbler 15 has a conical surface 15*a* which is constructed corresponding to the bore hole 6*a* of the insert 6. A cylindrical part 15*b* arranged at the other end of the tumbler 15 projects through or into the opening 14 of the bushing 13. As will be seen from FIG. 1, the tumbler 15 is pressed radially outward against the insert 6 by a control element 10 when the key 7 is inserted in the key slot 2.

The key 7 preferably has two control elements 9 and 10 which are inserted in a continuous stepped bore hole 8 at the front end of the key shank and are held in the positions shown in FIG. 1 by a cooperative or common pressure spring 12. The two control elements 9 and 10 are cylindrical pins, each having a flange 9*a* and 10*a*, respectively, which projects out radially. The flange 9*a* contacts a shoulder 8*a* of the stepped bore hole 8 so as to prevent the control element 9 from exiting at the outer end of the stepped bore hole 8. In a corresponding manner, the flange 10*a* of the control element 10 contacts a sleeve 11 which is inserted into the stepped bore hole 8 with a press fit. As will be seen, the control faces 9*b* and 10*b* of the elements 9 and 10 lie exactly flush with the narrow sides 7*a* of the key 7 in the positions shown in FIG. 1. The mechanical control device with the elements 9 and 10 and the pressure spring 12 is comparatively simple to produce and operates reliably.

The control elements 9 and 10 can be moved inward into the stepped bore hole 8 to a limited extent against the reaction force of the pressure spring 12. The reason for this movability will become clear from the following description.

In order to actuate the rotary locking cylinder, the shank of the key 7 is inserted into the key slot 2 in a conventional manner. In so doing, the conventional tumblers (not shown in the drawing) are brought into line by the conventional bore holes of the key. In the arrangement shown in FIG. 1, the tumbler 15 is also lifted by the control element 10 so that it engages in the recess 6*a* of the insert 6. When turning the key, the tumbler 15 is lifted by the control element 9 in a corresponding manner. Since the tumbler 15 and the control element can be moved inwardly against the reaction force of the pressure spring 12, the rotor 1 can be turned with the key, e.g. in the counterclockwise direction with reference to FIG. 1, in spite of the engagement of the tumbler 15 in the recess 6*a*. Of course, this is only possible if the recess 6*a* and, in corresponding manner, the surface 15*a* are constructed conically. When the rotor 1 is turned, the tumbler 15 moves inward radially until a planar end face 15*b* reaches the shear line 27 between the rotor 1 and stator 3.

If an attempt is made to actuate the rotary locking cylinder using a key without the movable control element, the rotor 1 will be blocked by the tumbler 15 even if the conventional tumblers are brought into line, since this tumbler 15 contacts the shank of the key and cannot be deflected radially inward. When the insert 6, tumbler 15 and bushing 13 are produced from a hard material, e.g., hardened steel, the rotor 1 can also not be turned by force. Thus, when high forces are applied, only the handle of the key can break off.

Figure 2:
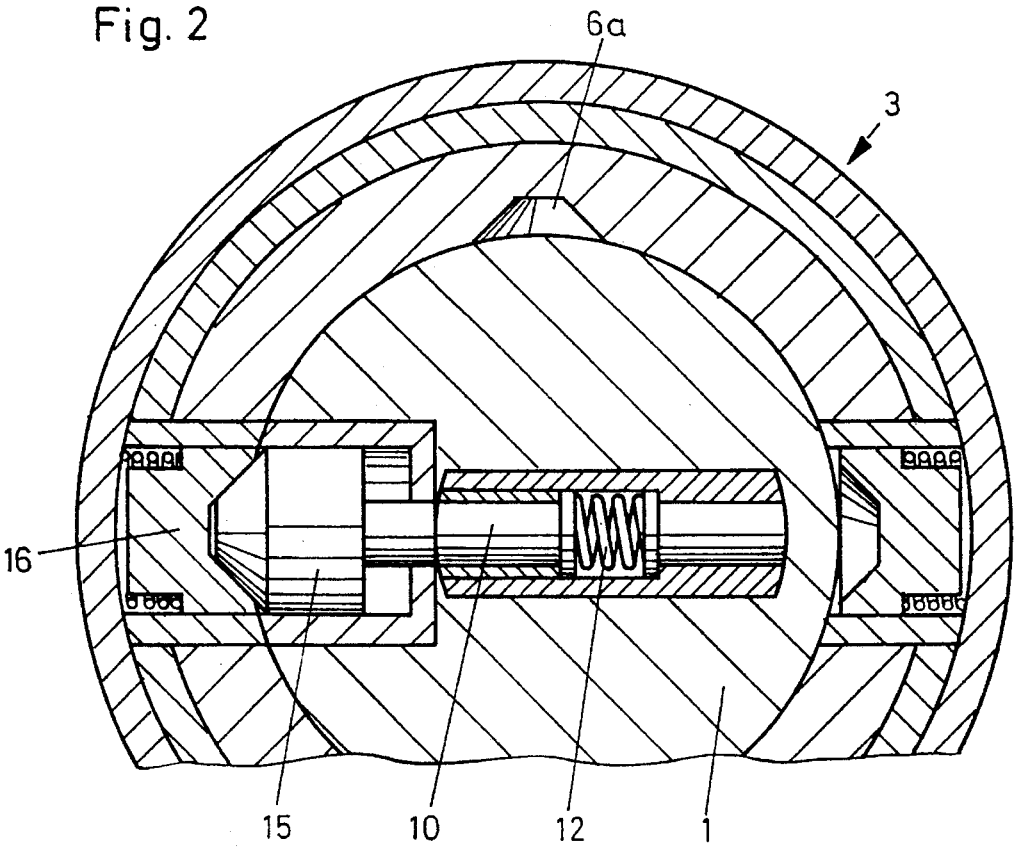
FIG. 2 shows a cross section according to FIG. 1, but after the rotor has been rotated by 90°.
Figure 3:
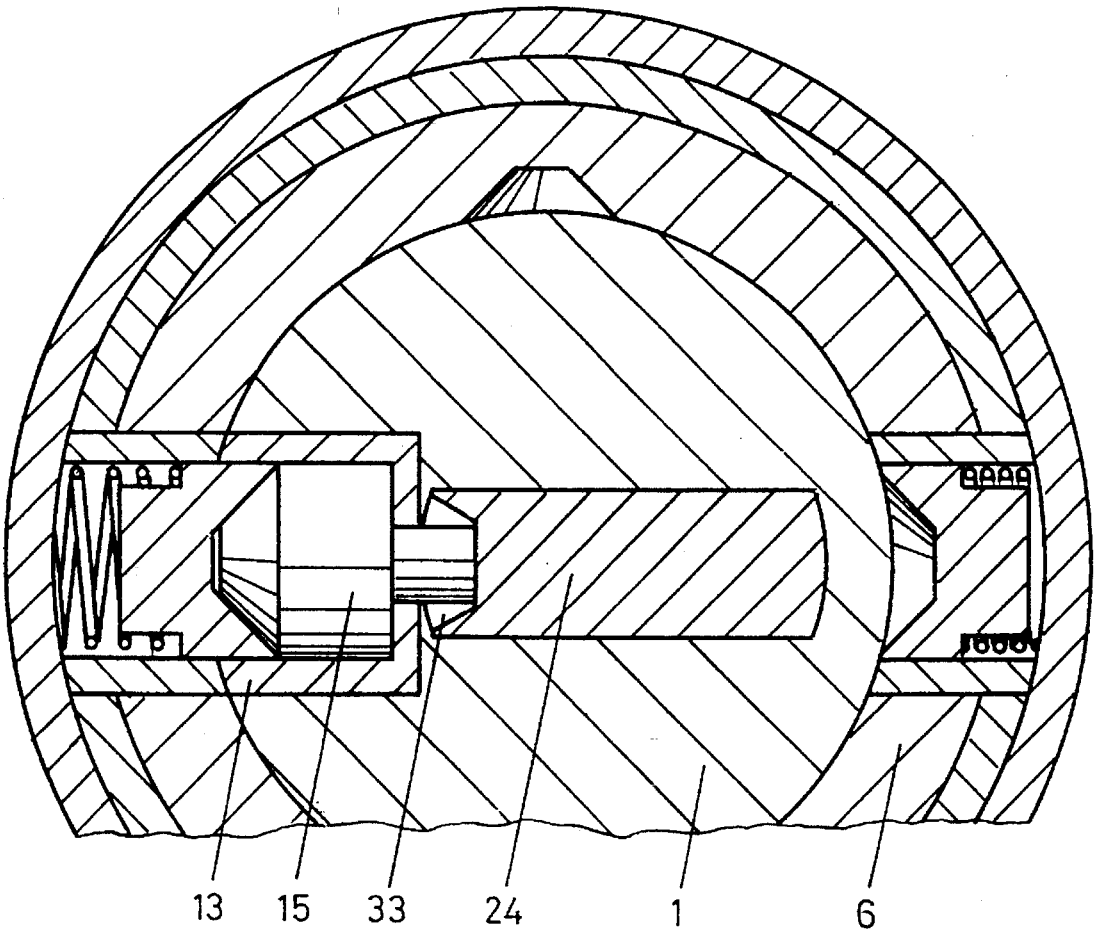
FIG. 3 shows a section according to FIG. 2, but with a key lacking the control element.
Figure 4A:
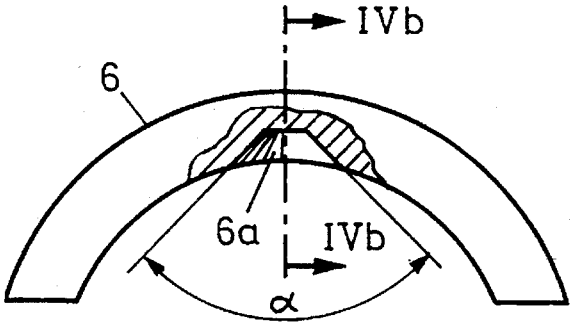
FIGS. 4*a* and 4*b* show a projected view and cross section, respectively, through an insert.
Figure 4B:
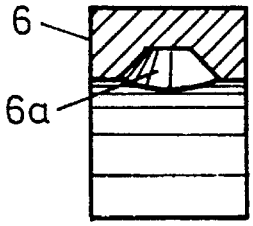

If a key 24 according to FIG. 3 has a bore hole 33 at a corresponding position rather than a control element 9 or 10, the tumbler 15 is not engaged with the insert 6 and the rotor can accordingly be turned provisionally when the conventional tumblers are brought into line. However, after the rotor 1 turns by 90° in the clockwise direction or counterclockwise direction, the counterpin 16 falls into the interior of the sleeve 13 and blocks the rotary locking cylinder. In this case, the rotor 1 cannot be turned into the position in which the lock is unlocked. When using a key 7, according to the invention, provided for the rotary locking cylinder, the counterpin 16 is brought into line by means of the tumbler 15 and the rotor can accordingly be turned by an additional 90° into the position in which the lock is unlocked. In order for the tumbler 15 to bring the counterpin 16 into line, the pressure spring 12 is constructed so as to be thicker than the pressure spring 20 which presses the counterpin 16 radially inward. As is conventional, per se, the counterpin 16 has a conical bore hole 23 which is constructed corresponding to the surface 15*a* of the tumbler 15. The counterpin 17 which is arranged on the opposite side and has the bore hole 22 and the pressure spring 21 performs exactly the same function. FIG. 2 clearly shows how the counterpin 16 is brought into line by the tumbler 15 in the appropriate rotational position of the rotor 1. When the rotor 1 is rotated out of this position, e.g. in the counterclockwise direction, the tumbler 15 is deflected radially inward and the control element 10 is moved radially inward against the reaction force of the pressure spring 12 in a corresponding manner. As can be seen, the rotary locking cylinder can be actuated in a conventional manner with an appropriate key 7 according to the invention. However, it is not possible to actuate the lock with a key which lacks the control element even if extensive force is applied.

While the foregoing description and drawings represent the preferred embodiments of the present invention, it will be obvious to those skilled in the art that various changes and modifications may be made therein without departing from the true spirit and scope of the present invention.

What is claimed is:

1. A key and rotary locking cylinder having tumblers for a safety lock comprising:

a) a key having at least one control element arranged in a shank of said key, said control element being displaceable radially against a restoring force of a pressure spring; and b) a rotary locking cylinder having a rotor and a stator, said rotor having an additional tumbler for cooperating with said control element of said key, said stator having a recess at an inner side in which said additional tumbler of said rotor engages by means of action of said control element, said additional tumbler being moveable radially inwardly against the spring restoring force when said rotor is rotated;

said cylinder also including a counterpin which can be brought into line by said additional tumbler and which is arranged at a distance from said recess, wherein an insert having said recess which cooperates with said additional tumbler is inserted into another recess of said stator.

2. The key and cylinder according to claim 1, wherein said insert is made from a hard metal.

3. The key and cylinder according to claim 1, wherein said insert is made from hardened steel.

4. The key and cylinder according to claim 1, wherein said insert is constructed in a curved shape.

5. A key and rotary locking cylinder having tumblers for a safety lock comprising:

a) a key having at least one control element arranged in a shank of said key, said control element being displaceable radially against a restoring force of a pressure spring; and b) a rotary locking cylinder having a rotor and a stator, said rotor having an additional tumbler for cooperating with said control element of said key, said stator having a recess at an inner side in which said additional tumbler of said rotor engages by means of action of said control element, said additional tumbler being moveable radially inwardly against the spring restoring force when said rotor is rotated;

said cylinder also including a counterpin which can be brought into line by said additional tumbler and which is arranged at a distance from said recess, wherein said shank of said key has a continuous stepped bore hole in which is inserted a pressure spring which acts upon two opposite control elements, and wherein a sleeve is pressed into the stepped bore hole and wherein a control element is guided into the sleeve.

6. The key and cylinder according to claim 5, wherein each control element has a flange at its inner end, which flanges contact a shoulder and said sleeve, respectively.

* * * * *